United States Patent [19]

Skinner

[11] 4,111,173

[45] Sep. 5, 1978

[54] FUEL PUMPING APPARATUS

[75] Inventor: Robert Thomas John Skinner, High Wycombe, England

[73] Assignee: Lucas Industries Limited, Birmingham, England

[21] Appl. No.: 774,123

[22] Filed: Mar. 3, 1977

[30] Foreign Application Priority Data

Mar. 10, 1976 [GB] United Kingdom ..... 9446/76

[51] Int. Cl.[2] ..... F02M 63/00

[52] U.S. Cl. ..... 123/139 AQ; 123/139 AF; 137/512.1

[58] Field of Search ..... 123/139 AF, 139 AP, 123/139 AQ; 137/512.1, 512.3, 512.5

[56] References Cited

U.S. PATENT DOCUMENTS

| | | | |
|---|---|---|---|
| 3,308,799 | 3/1967 | Bessiere | 123/139 AQ |
| 3,967,644 | 7/1976 | St. Laurent | 137/512.1 |
| 4,038,956 | 8/1977 | Perr et al. | 123/139 AF |

FOREIGN PATENT DOCUMENTS

| | | | |
|---|---|---|---|
| 204,751 | 2/1955 | Australia | 123/139 AF |
| 2,247,257 | 3/1974 | Fed. Rep. of Germany | 137/512.5 |
| 1,253,953 | 11/1967 | Fed. Rep. of Germany | 123/139 AF |
| 369,500 | 3/1939 | Italy | 123/139 AQ |
| 24,349 | 7/1971 | Japan | 137/512.1 |

*Primary Examiner*—Charles J. Myhre
*Assistant Examiner*—Andrew M. Dolinar

[57] ABSTRACT

A fuel pumping apparatus includes an injection pump to which fuel is supplied by means of a feed pump. A valve is provided to control the output pressure of the feed pump and a pressure responsive piston responsive to the output pressure of the feed pump modifies the timing of delivery of fuel by the injection pump. The valve comprises first and second valve elements which are resiliently loaded in one direction. The first valve element is exposed to the output pressure of the feed pump and is movable by this pressure to allow fuel to flow through an orifice. The second valve element is subjected to the pressure upstream of the orifice and is movable firstly to reduce the force acting on the first valve element due to the resilient loading and after moving a predetermined distance progressively opens a spill port. The second valve element is larger than the first valve element and the effect is that initially the output pressure of the feed pump increases with increasing engine speed and then with further increase of speed falls but then with still further increase in engine speed starts to rise.

6 Claims, 5 Drawing Figures

FUEL PUMPING APPARATUS

This invention relates to fuel pumping apparatus of the kind comprising an injection pump which in use, is driven in timed relationship with an associated engine, a fuel feed pump for supplying fuel under pressure to the injection pump, a valve for controlling the output pressure of the feed pump and a fuel pressure operable piston responsive to the output pressure of the feed pump for adjusting the timing of delivery of fuel to the associated engine, the arrangement being such that the timing of delivery of fuel is advanced with increasing feed pump output pressure.

All engines have a desirable speed/timing characteristic and in some engines it is desirable that the timing should advance at a high rate as the speed increases and then retard for a period during further speed increase and then advance at a lower rate with further increase of speed. In order to achieve this the feed pump output pressure must vary in the required manner and the object of the present invention is to provide an apparatus of the kind specified in which this desideratum is achieved.

According to the invention in an apparatus of the kind specified said valve comprises a first resiliently loaded valve element which is subjected to the output pressure of the feed pump and which when the pressure rises to a pre-determined valve opens to allow fuel flow through an orifice, a second resiliently loaded valve element subjected to the intermediate pressure of fuel between the first valve element and the orifice said second valve element when subjected to said intermediate pressure acting to reduce the resilient loading on the first valve element, said second valve element acting to control the size of a spill port in parallel with said orifice and which starts to open when the second valve element has been moved a pre-determined extend by the intermediate pressure, said second valve element having a greater area exposed to said intermediate pressure than the area of the first valve element which is exposed to the output pressure of the feed pump.

Figure 1:
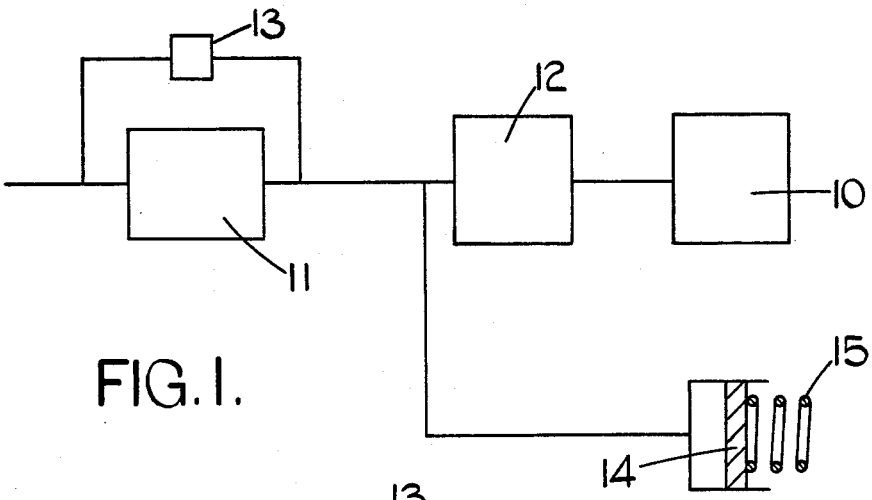
Figure 2:
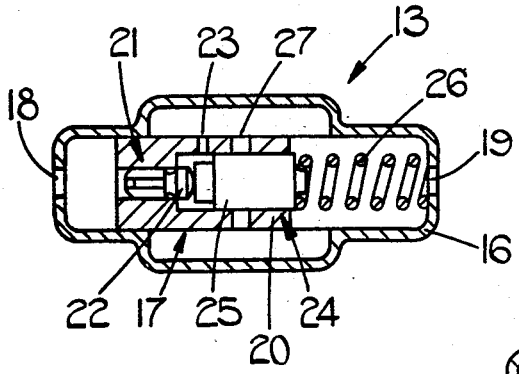
Figure 3:
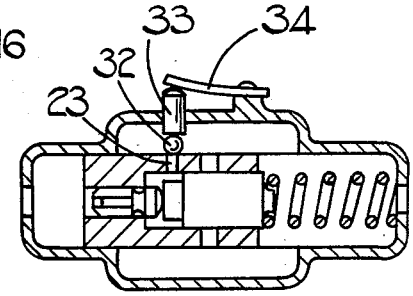
Figure 4:
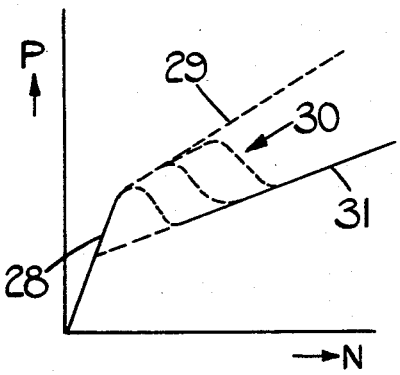
Figure 5:
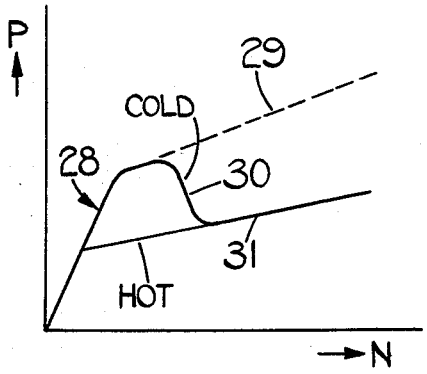

One example of an apparatus in accordance with the invention will now be described with reference to the accompanying drawings in which;

FIG. 1 is a diagrammatic view of the apparatus,

FIGS. 2 and 3 are sectional side elevations showing different embodiments of a valve shown in FIG. 1 and FIGS. 4 and 5 show the variation of the output pressure of the feed pump in relation to speed, obtained with the valves of FIGS. 2 and 3 respectively.

Referring to FIG. 1 of the drawings the apparatus comprises an injection pump 10 which in use, is driven in timed relationship with an associated engine and delivers fuel to the combustion spaces of the engine in turn. Fuel under pressure is supplied to the injection pump 10 by means of a fuel feed pump 11 and the amount of fuel supplied by the injection pump to the engine is conveniently controlled by means of a regulating device 12 which determines the rate of fuel supply to the injection pump. The output pressure of the feed pump is controlled by the relief valve 13 which spills fuel from the outlet of the pump to the inlet thereof.

In order to adjust the timing of delivery of fuel to the engine the injection pump includes a fluid pressure operable piston 14 housed within a cylinder. The piston is connected to a part of the injection pump 10 conveniently the cam which effects movement of the pumping plungers of the injection pump. Moreover, the piston is resiliently loaded by means of a spring 15 in the direction to retard the timing of injection of fuel. As the pressure applied to the piston 14 increases the aforesaid cam is moved angularly to advance the timing of injection of fuel. As shown pressure is applied directly to the piston 14 however, it will be appreciated that the piston 14 may be replaced by a servo-valve forming with the piston 14, a follow-up servo system. Such apparatus is well known in the art.

With reference now to FIG. 2 of the drawings the valve 13 comprises a housing 16 which in practice forms part of the housing of the feed pump 11. Located within a cavity in the housing is a valve assembly 17 one end of which extends into a reduced portion of the cavity to which fuel is supplied through an inlet 18 from the outlet of the feed pump 11. The opposite end of the housing is provided with a fuel outlet 19 which conveniently is connected to the inlet of the feed pump 11. The valve assembly 17 comprises a body part 20 in which is defined a stepped cylindrical bore the narrower end of which is open to the inlet 18. Slidable within the narrower end of the bore is a first valve element 21 which has a fluted portion in the bore, the fluted portion being connected to a head 22 which is located in the wider portion of the bore and which is slightly larger than the narrower end of the bore. Moreover, slidable in the wider portion of the bore is a second valve element 24.

The second valve element comprises a cylindrical member 25 having a reduced portion at its end presented to and in contact with the head 22 so as to form a chamber for which the orifice 23 extends. Furthermore, the opposite end of the cylindrical member defines an abutment for a coiled compression spring 26. Also formed in the body of the valve assembly is a pair of diametrically disposed ports 27 which are uncovered to the wider portion of the bore after the second valve element has moved a pre-determined extent against the action of the spring. The orifice 23 and the ports 27 communicate with the outlet 19.

The feed pump 11 is arranged so that under normal operating conditions it delivers an excess of fuel that is to say, it delivers more fuel than is supplied to the engine. Referring to FIG. 4 as the speed of operation of the apparatus increases, the pressure at the outlet of the feed pump increases at a first rate indicated by the line 28. This increase in pressure continues until the first valve element 22 which is of course loaded indirectly by the spring 26, moves to allow fuel flow from the narrower end of the bore into the chamber and through the orifice 23. Neglecting for the moment the existance of the orifice 23 the first valve element would control the pressure so that it followed the line 29 however, the orifice 23 imposes a restriction to the flow of fuel and the pressure (called the intermediate pressure,) upstream of the orifice 23 acts upon the second valve element 24. The valve element 24 is larger than the valve element 21 and the force developed on it by the intermediate pressure opposes the force exerted by the spring 26. Thus the force exerted by the spring acting on the first valve element 21 is reduced and the fuel pressure starts to fall, the pressure following one of the lines 30 indicated in FIG. 4 depending upon the size of the orifice 23. With a small orifice the pressure will start to fall quickly but if the orifice size is increased then the pressure will tend to follow the line 29 before the reduction in pressure occurs. As the flow of fuel from the outlet of the feed pump increases the intermediate pressure will increase and the second valve element 24 will move further against the action of the spring 26 until it begins to open the ports 27. When this occurs the first valve element 21 is offering substantially no hinderance to the flow of fuel and the pressure of fuel at the inlet 18 then follows the line 31 in FIG. 4 that is to say the output pressure of the feed pump starts to increase again, the pressure being controlled by the second valve element 24 which determines the size of the ports 27.

A modification of the valve shown in FIG. 2 is seen in FIG. 3 and all components of the valve are exactly the same. The only addition is a ball valve 32 which is loaded through a plunger 33 by means of a temperature sensitive device such for instance as a bi-metal spring 34. When the spring 34 is hot then the ball valve 32 is held in a position to prevent flow of fuel through the orifice 23. However, when the bi-metal spring is cold then the ball valve 32 is allowed to move to a position in which there is substantially no restriction to the flow of fuel through the orifice 23. Hence when the spring is cold the pressure/speed characteristic is substantially the same as that which is obtained with the valve shown in FIG. 2. This is illustrated in FIG. 5. When the bi-metal spring 34 is hot then the flow of fuel through the orifice 23 is prevented and the second valve element 24 is subjected to the outlet pressure of the feed pump. The pressure/speed characteristic which is obtained therefore follows the line 31 and starts to follow this line at its point of intersection with the line 28.

It will be appreciated that other forms of thermal sensitive device may be used for example, a temperature responsive capsule.

I claim:

1. A fuel pumping apparatus comprising an injection pump which in use is driven in timed relationship with an associated engine, means including a fuel feed pump for supplying fuel under pressure to the injection pump, a relief valve for controlling the output pressure of the feed pump, said relief valve being located in a line operatively connected with said feed pump, and means including a fuel pressure operable piston for adjusting the timing of delivery of fuel by the injection pump to the associated engine, said piston being responsive to the output pressure of the feed pump, said relief valve comprising a first resiliently loaded valve element which is subjected to the output pressure of the feed pump; an orifice and a spill port located downstream of said first valve element, said first valve element when the pressure rises to a predetermined value opens to allow fuel flow through said orifice, a second resiliently loaded valve element subjected to the intermediate pressure of fuel between the first valve element and the orifice, said second valve element when subjected to said intermediate pressure acting to reduce the resilient loading on the first valve element, said second valve element acting to control the size of said spill port which is in parallel with said orifice and which starts to open when the second valve element has been moved a predetermined extent by the intermediate pressure, said second valve element having a greater area exposed to said intermediate pressure than the area of the first valve element which is exposed to the output pressure of the feed pump.

2. An apparatus according to claim 1 including temperature responsive means operable to prevent flow of fuel through said orifice.

3. An apparatus according to claim 1 in which said valve comprises a body defining a stepped bore, said first valve element being slidable within the narrower part of the bore and the second valve element in the wider portion of the bore, resilient means acting on said second valve element to urge it into contact with the first valve element, the valve including an inlet for connection to the outlet of the feed pump so that the output pressure of the feed pump can act on the first valve element, said orifice extending through the wall of said bore and communicating with a chamber defined in part by a reduced portion of the second valve element adjacent the first valve element, said spill port also extending through the wall of said bore and being positioned so as to be uncovered to said chamber after the second valve element has moved said predetermined extent.

4. An apparatus according to claim 3 in which said first valve element has a fluted portion within the narrower portion of the bore and a head disposed in said chamber, said head being slightly larger than the narrower portion of the bore.

5. An apparatus according to claim 4 including a valve member movable to prevent flow through said orifice, and temperature responsive means for moving said valve member to the closed position.

6. An apparatus according to claim 5 in which said temperature responsive means comprises a bi-metal spring.

* * * * *